US006635121B2

(12) United States Patent
Rancon et al.

(10) Patent No.: US 6,635,121 B2
(45) **Date of Patent: *Oct. 21, 2003**

(54) METHOD AND APPARATUS FOR CONTROLLING THE DECARBURIZATION OF STEEL COMPONENTS IN A FURNACE

(75) Inventors: Yannick Rancon, Hinsdale, IL (US); Hunter Spoon, New Lenox, IL (US)

(73) Assignees: American Air Liquide, Inc., Fremont, CA (US); L'Air Liquide, Societe Anonyme pour l'Etude et l'Exploitation des Procedes Georges Claude, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/498,199

(22) Filed: Feb. 4, 2000

(65) Prior Publication Data

US 2003/0131912 A1 Jul. 17, 2003

(51) Int. Cl.[7] ..... C23C 8/06

(52) U.S. Cl. ..... 148/208; 148/215; 148/216; 266/99

(58) Field of Search ..... 148/215, 216, 148/208, 505; 266/99

(56) References Cited

U.S. PATENT DOCUMENTS

| | | | | |
|---|---|---|---|---|
| 4,049,473 A | * | 9/1977 | Davis, II et al. | 148/16.5 |
| 4,175,986 A | * | 11/1979 | Ewalt et al. | 148/16.5 |
| 4,372,790 A | * | 2/1983 | Gohring et al. | 148/16.5 |
| 4,445,945 A | * | 5/1984 | Schwalm | 148/16 |
| 4,992,113 A | | 2/1991 | Baldo et al. | 148/160 |
| 5,741,371 A | * | 4/1998 | Roggatz | 148/216 |

FOREIGN PATENT DOCUMENTS

GB 2092183 * 1/1981

OTHER PUBLICATIONS

Powder Injection Molding Symposium—1992: Atmosphere Process for the Control of the Carbon and Oxygen Contents of Injection Molded Steel Parts During Debinding.
Advances in Powder Metallurgy—1991; vol. 4: Atmosphere Influence on Decarburization of Parts During Steel Sintering.
Compaction, Sintering and Secondary Operations Advances in Particulate Materials—1994; vol. 3: Economical On–Site Nitrogen Atmospheres for Sintering and Heat Treating.
Tech Specs ALNAT FC Controlled Neutral Atmosphere for Annealing & Hardening; Liquid Air 1990.
Industrial Heating: The Journal Of Thermal Technology–May 1992. Literature Showcase Induction Heat Treatment.
Industrial Heating: The Journal Of Thermal Technology–Process Controls & Instrumentation, Heat Treatments, Vacuum/Surface Treatments, Business Trends. No Date.
Industrial Heating: The Journal Of Thermal Technology–Nov. 1992. Ceramics & Refractories/Insulation, Heat & Corrosion Resistant Material, Power Metallurgy/Heat Treatments, Industrial Gases/Energy.
Air Liquide America Corporation: Save up to 50% on Cryogenic Quality Nitrogen. No Date.
Tech Spec ALNAT Sampler; Air Liquide. No Date.

(List continued on next page.)

*Primary Examiner*—Roy King
*Assistant Examiner*—Andrew Wessman
(74) *Attorney, Agent, or Firm*—Linda K. Russell

(57) ABSTRACT

The invention relates to a method for controlling the decarburization of steel components in a furnace during heat treating processes. The concentration of $CO_2$ and/or CO in the furnace is monitored in a first batch in order to determine periods of elevated $CO_2$/CO concentrations, and inert gas is injected in subsequent batches during the previously determined periods of elevated $CO_2$/CO concentrations.

40 Claims, 2 Drawing Sheets

TYPICAL Temperature,CO2,flow profiles per invention

OTHER PUBLICATIONS

Liquid Air: ALNAT*–CD For Quicker Carburizing and Carbonitriding—1986.

Tech Specs, Air Liquide: ALNAT C: Nirtogen–Methanol Sourcing, Service & Support. Aug. 1993.

Liquid Air: Flow Panel With Carbon Controller. ALNAT*C: Flow Panel Features—1986.

Industrial Heating: The Journal Of Thermal Technology, Oct. 1991. Heat Treatments, Process Controls & Instrumentation, Vacuum/Surface, Melting/Forming/Joining.

Air Liquide 1998: Advanced Heat Treating Technology for Improved Efficiency and Quality.

Apparatus And Methods For Generating An Artificial Atmosphere For The Heat Treating Of Materials. No Date.

* cited by examiner

METHOD AND APPARATUS FOR CONTROLLING THE DECARBURIZATION OF STEEL COMPONENTS IN A FURNACE

BACKGROUND OF THE INVENTION

The invention relates to controlling the decarburization of steel components in a furnace during heat treating processes, such as annealing.

During annealing, the metal is heated and then cooled (sometimes repeatedly), usually for the purpose of softening the metal and making it less brittle, therefore, facilitating subsequent cold forming operations. Annealing is often done in batch furnaces, typically bell furnaces or box furnaces. Annealing of carbon-containing steel elongated products (such as wires and rods) is typically done before and after drawing. During drawing, the metal is spread, elongated, pulled, or stretched, for example.

Heat treating processes may be done under different atmospheres in order to minimize scale. Scale is an oxide layer that forms on the iron metal surface during the heating process. Examples of iron oxides include FeO, $Fe_2O_3$, and $Fe_3O_4$.

In addition to scale, decarburization also may occur under different atmospheres. During decarburization, the metal loses carbon to the atmosphere. One skilled in the art will appreciate the variety of types of steel that may be heat treated, as well as the different uses for heat-treated steel. For any particular type of steel or use, there might be a specific amount of decarburization that is allowable during the heat treating process, or it may be that no decarburization is allowed ("zero decarburization"). The allowable limit of decarburization is known as a decarburization specification. For instance, if carbon-containing steel loses carbon during the heat treating process, then the steel will become softer than it was prior to the heat treating process. This may or may not be acceptable to the customer or the intended use for the steel during future tooling.

In addition to decarburization, recarburization may also result from different atmospheres. During recarburization, the metal gains carbon during the heat treating process.

Naturally, the simplest option is to use ambient air as the heat-treating atmosphere within the furnace. However, particularly if the metal being annealed is iron-based, heavy scaling will occur. Decarburization can also occur.

An exogas may also be used for the furnace atmosphere. Exogas is a gas that is generated by an exothermic generator via the combustion of hydrocarbon (typically natural gas) and air. Exogas composition typically contains approximately 2–15% $H_2$, 1–8% CO, and the balance is $N_2$ and impurities such as $CO_2$ and $H_2O$. This atmosphere may provide protection against oxidation (scale), but heavy decarburization can occur.

An endogas is another option for the furnace atmosphere. Endogas is a gas generated by an endothermic generator via a catalytic reaction of hydrocarbon (typically natural gas) and air. Endogas composition typically contains approximately 40% $H_2$, 20% CO, and the balance is $N_2$ and impurities such as $CO_2$ and $H_2O$. Endogas is a powerful reducing atmosphere, where $H_2$ and CO act as scavengers of $O_2$, $CO_2$, and $H_2O$ (oxidizing and decarburization species). However, $H_2$ and CO will also react with metal oxides in the furnace (load, stems, radiant tubes, etc.) to generate moisture, which can, in turn, contribute to decarburization. In addition, endogas composition may fluctuate for many of the following reasons. The natural gas composition may vary. There may also be natural gas/air ratio drift. Catalyst performance may also change over time. Recarburization and decarburization can also be difficult to control, because the furnace temperature also varies during the thermal cycle of a batch furnace.

Nitrogen alone is also an option to use as a furnace atmosphere. However, since nitrogen does not react with decarburizing species such as $CO_2$ and $H_2O$, if $CO_2$ and $H_2O$ are present in sufficient quantities, decarburization can still occur. Pure nitrogen is used on low carbon steel where decarburization specifications are not too tight. In other words, in low carbon steel, greater decarburization may be acceptable to the customer or to the intended use for the steel.

Another furnace atmosphere may combine nitrogen and endogas. Recarburization and decarburization of the metal may occur in this atmosphere for various reasons. The endogas composition may fluctuate over time. In addition, the reducing species of the endogas may react with metal oxides in the furnace to generate a high dew point. Because nitrogen does not react with $H_2O$, decarburization may result. Also, the furnace temperature may vary during the thermal cycle of a batch furnace, and this makes it difficult to control recarburization and decarburization.

Yet another furnace atmosphere combines nitrogen and a hydrocarbon. Since nitrogen alone does not protect against decarburizing and oxidizing species ($H_2O$ and $CO_2$), quantities of hydrocarbon (methane, propane, or propylene for instance) are added in order to generate reducing species which are going to react with $H_2O$ and $CO_2$. However, reducing species also react with metal oxides, generating moisture which, in turn, can contribute to decarburization. Chemical reactions involving hydrocarbons at temperatures typically encountered for elongated product annealing (1275° F.–1600° F.) have slow kinetics. Slow kinetics means that thermodynamic equilibrium is not reached within reasonable short times. If thermodynamic equilibrium is not reached, this means that the equations valid at equilibrium cannot be used for controlling the atmosphere. Therefore, the addition of hydrocarbons makes it difficult to regulate recarburization and decarburization.

For all of these various furnace atmospheres, the gas flow rate is typically kept below or at about 1 renewal per hour. One renewal per hour equals a gas flow sufficient to replace the furnace atmosphere within an hour. Consequently, the actual flow rate of the gas into the furnace chamber depends on the size of the furnace chamber. Flow rate per hour is equal to: (the number of renewals per hour) times (the internal volume of the furnace). For instance, a flow of 1,000 cubic feet per hour of gaseous $N_2$ into a 1,000 cubic foot furnace would give a flow rate of 1 renewal per hour.

When the gas flow rate is low, then the atmosphere in the furnace may lose its positive pressure. Positive pressure means that the pressure inside the furnace is greater than the pressure of the ambient air. When there is positive pressure inside the furnace, then the furnace atmosphere will tend to leak out of the furnace. Conversely, when the furnace atmosphere does not maintain a minimum pressure, then the ambient air will tend to enter the furnace. As a result of ambient air entering the furnace, the oxygen that is in the ambient air may cause oxidation and decarburization to the metal.

SUMMARY OF THE INVENTION

Briefly stated, the invention is an apparatus and a method for controlling the decarburization of a steel component during heat treating in a furnace.

In accordance with a method aspect, the method includes heat treating at least one batch of steel components, injecting an inert gas into furnace, and measuring and recording the concentration of $CO_2$ or CO. For the sake of brevity, the abbreviation of "$CO_2$/CO" shall mean "either $CO_2$ alone CO alone or $CO_2$ and CO combined." The concentration of $CO_2$/CO at various times during the process gives a $CO_2$/CO concentration profile. The $CO_2$/CO concentration profile is used during the heat treating of subsequent batches of components. An inert gas (such as $N_2$) is injected into the furnace at a flow rate of at least about 2 renewals per hour at predetermined times during the process, correlated to elevated concentrations in the $CO_2$/CO concentration profile.

"Elevated concentrations" are preferably defined in relation with the decarburization specification. If a batch of steel components is processed in a given furnace under given conditions (load, temperature, flows, grade, etc.) and if, after treatment, it does not meet the given decarburization specification, then the CO/$CO_2$ concentration recorded during the process is, a posterior, considered as "elevated concentrations" relative to the given decarburization specification. If another batch of steel components is processed in a given furnace under given conditions and if it does meet the expected decarburization specification, then the CO/$CO_2$ concentration recorded during the process are not, a posteriori, considered as "elevated concentrations" for the given decarburization specifications. Predetermined times for increasing the injection rate of the inert gas are determined, a posterior, (i.e., after processing at least one batch of steel components) as moments in the thermal cycle at which the $CO_2$/CO concentrations previously have been identified as "elevated concentrations."

In accordance with a further method aspect, the method includes an analyzer to monitor the $CO_2$/CO concentration in the furnace during the heat treating process. It further includes injecting inert gas (such as $N_2$) in response to a signal from the analyzer. At elevated $CO_2$/CO concentrations, the inert gas is injected into the furnace at a flow rate of at least about 2 renewals per hour.

In accordance with an apparatus aspect, the apparatus includes an analyzer to monitor the $CO_2$/CO concentration in the furnace. It further includes a gas injector, which, responsive to a signal from the analyzer indicating an elevated $CO_2$/CO concentration, injects inert gas into the furnace at a flow rate of at least about 2 renewals per hour.

DETAILED DESCRIPTION OF THE INVENTION

Figure 1:
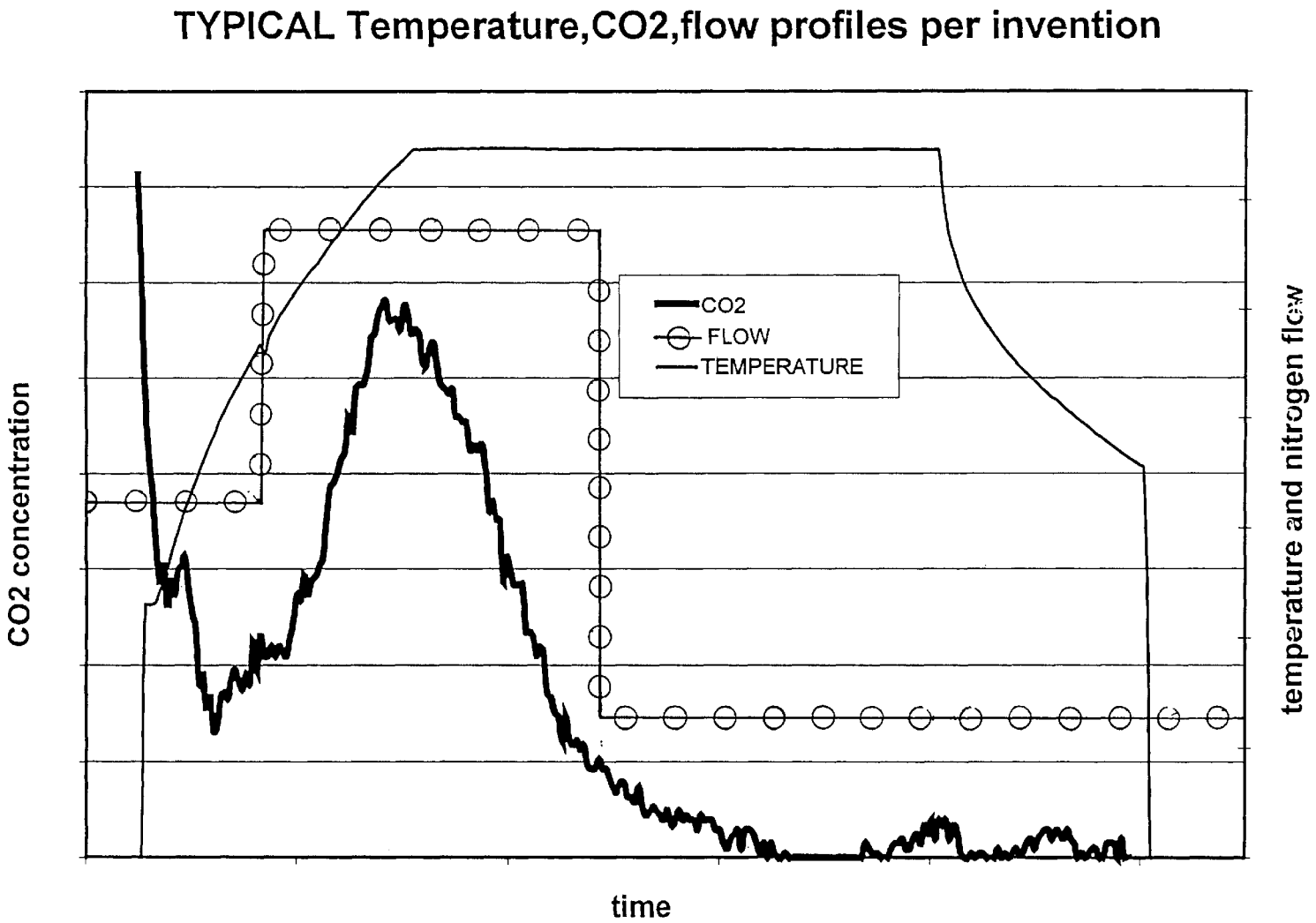
FIG. 1 is a graph of a typical temperature, $CO_2$, and flow rate during a typical thermal cycle. This figure plots the $CO_2$ concentration, the temperature, and the nitrogen flow as functions of time.

FIG. 1 is a graph that plots the dependent variables of temperature, $CO_2$ concentration, and $N_2$ flow rate over the independent variable of time during a typical thermal cycle. A thermal cycle means that the metal is heated and then cooled at temperature intervals defined periodically (occurring or recurring at regular intervals). This figure shows a thermal cycle for a heat treating process that happens to be annealing, where the metal is heat treated usually for the purpose of softening the metal and making it less brittle.

At the beginning of this typical thermal cycle shown in FIG. 1, the $N_2$ flow rate is approximately 1 renewal per hour ("RPH"). As the temperature ramps up, the $CO_2$ concentration also increases.

Integrating the area under the $CO_2$ graph gives the total quantity of $CO_2$ during a period of time. When more decarburization is occurring, it is typically reflected in a higher concentration of $CO_2$/CO.

FIG. 1 further shows that the $CO_2$ concentration decreases when the nitrogen flow rate is increased above 2 RPH during this temperature ramp. Therefore, by continuously monitoring the $CO_2$ concentration, and responding to an elevated concentration by injecting inert gas (such as $N_2$) into the furnace at a flow rate of at least about 2 renewals per hour, decarburization of a steel component in a furnace during a heat treating process, such as annealing, can be reduced, eliminated, or at least controlled within a pre-determined decarburization specification.

Also shown in FIG. 1 is that $N_2$ flow rate can be lowered after the $CO_2$ concentration has been decreased. In other words, during the temperature ramp the $CO_2$ concentration was also observed to be increasing, but when inert gas (such as $N_2$) was injected at a flow rate in excess of 2 RPH, the $CO_2$ concentration tended to decrease during the remainder of the temperature ramp and during the time that the temperature was substantially constant (the soak temperature). Having lowered the $CO_2$ concentration, the $N_2$ flow rate then was reduced without any substantial increase in the $CO_2$ concentration, and $N_2$ therefore was conserved.

While FIG. 1 shows that decarburization can be controlled by monitoring the $CO_2$ concentration and responding to a high $CO_2$ concentration with a $N_2$ flow rate in excess of 2 RPH, it should be understood by one skilled in the art that CO also could be monitored. Where $CO_2$ is observed to be increasing during the temperature ramp, CO would also be increasing (under inert gas atmosphere). Therefore, either $CO_2$ or CO may be monitored. Both gaseous compounds are easy to analyze contrary to the complexity of analyzing $H_2Q$ (dew point).

Against the backdrop of FIG. 1, one may control the decarburization of steel components in a furnace during heat treating processes. One method is to heat treat at least one batch of steel components and to measure and record the $CO_2$/CO concentration preferably while an inert gas (such as nitrogen) is injected into the furnace. The concentration of $CO_2$/CO at various times during the process gives a $CO_2$/CO concentration profile.

The $CO_2$/CO concentration profile is used during the heat treating of subsequent batches of components. The profile is also used in conjunction with the decarburization results from at least one batch, and in conjunction with the decarburization specification. Based on this profile and based on the decarburization results from at least one batch, one may determine at which periods of time in the process, higher concentrations of $CO_2$/CO have developed, and if such higher concentrations of $CO_2$/CO occurred for a batch that did not meet the decarburization specification. If such failure to meet the decarburization specification happened, the higher concentrations of $CO_2$/CO, recorded previously during certain period(s) of time, are defined as elevated concentrations.

Therefore, during subsequent heat treating of batches of components (under similar conditions and similar decarburization specification), an inert gas (such as $N_2$) is injected into the furnace at a flow rate of at least 2 RPH during the very same period(s) of time (further named "pre-determined times"), previously correlated to elevated concentrations in the $CO_2$/CO concentration profile.

For illustration, measurements of multiple batches may show a $CO_2$/CO concentration profile such that the $CO_2$ concentration, for instance, increases to a concentration considered as elevated concentration, over a period of time of 6 hours during the temperature ramp. It may further be found that there is a much more moderate increase in $CO_2$/CO concentration if inert gas (such as $N_2$) is injected into the furnace at a flow rate of at least about 2 renewals per hour at the predetermined time (for 6 hours in this hypothetical).

Another, method includes an analyzer to monitor the $CO_2$/CO concentration in the furnace during the heat treating process. It further includes injecting inert gas (such as $N_2$) in response to a signal from the analyzer. At elevated $CO_2$/CO concentrations, the inert gas is injected into the furnace at a flow rate of at least about 2 renewals per hour. An apparatus incorporating this method is illustrated in FIG. 2.

Figure 2:
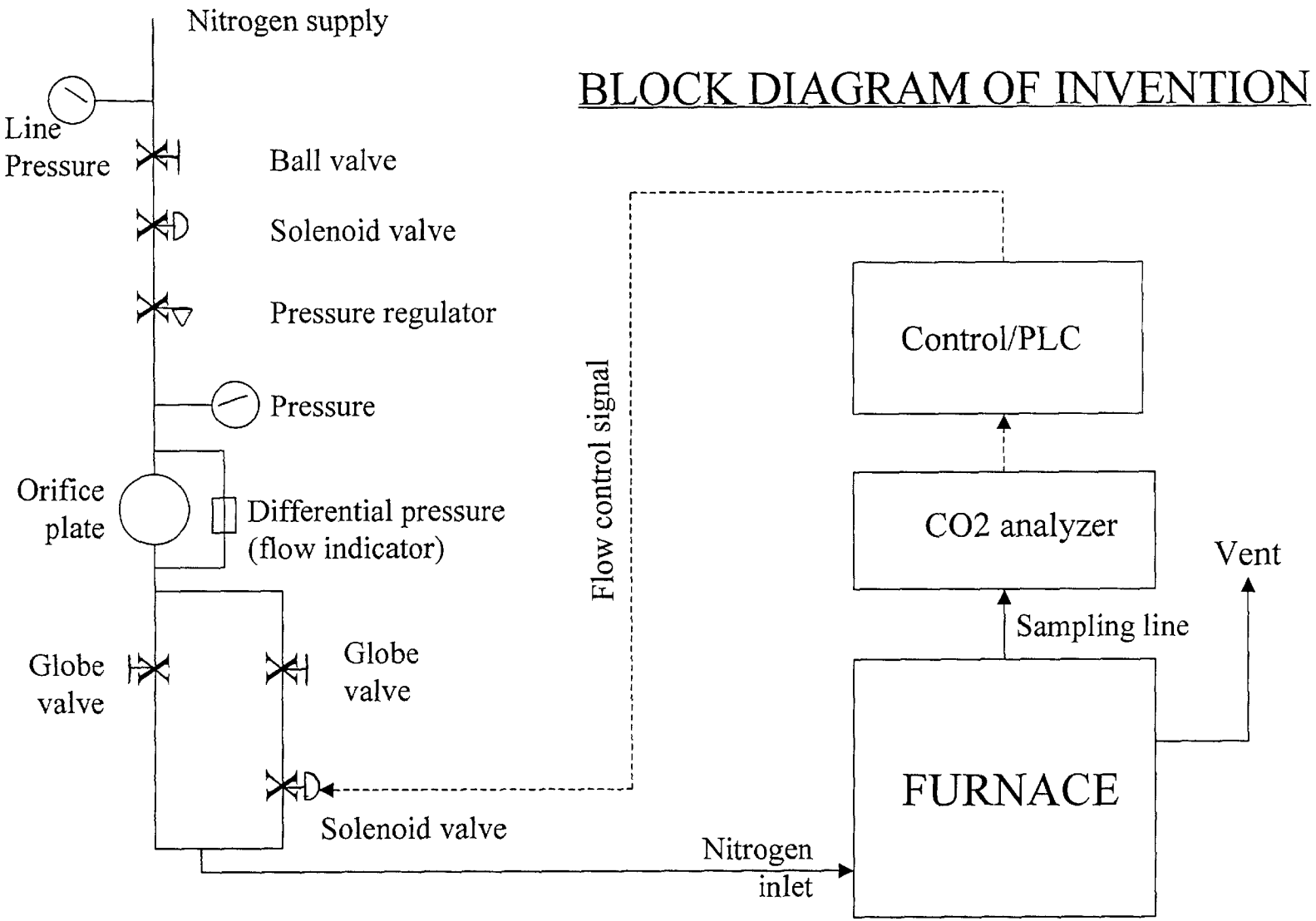
FIG. 2 is a block diagram of the preferred embodiment of the invention.

FIG. 2 is a block diagram showing an apparatus controlling the decarburization of steel components during a heat treating process in a furnace. Generally stated, it includes an analyzer to monitor $CO_2$/CO concentration and to generate a signal indicating an elevated $CO_2$/CO concentration. It further includes a gas injector, which, responsive to a signal from the analyzer indicating an elevated $CO_2$/CO concentration, injects inert gas into the furnace at a flow rate of at least about 2 renewals per hour.

Furnace

Heat treating processes are often done in batch furnaces. Two types of batch furnaces are typically bell furnaces or box furnaces.

The type of furnace used in FIG. 1 was a batch type furnace with a box style design with approximately 40,000 pounds capacity and with radiant electric heating to 1500° F. maximum. The alloy was low and medium carbon steel. In particular, the ASTM designations for the steel were 1006, 1010, 1018, 1022, 4037, 4140, and 10B22.

As shown in FIG. 2, the furnace also has a sampling line that connects the furnace to a $CO_2$/CO concentration analyzer. The sampling line is for taking samples of the atmosphere inside of the furnace. The sampling line should be inert to all gaseous compounds in the furnace atmosphere. The sampling line is preferably a ¼ inch OD polyethylene tubing, such as Imperial Eastman #44-P, and most preferably a ¼ inch OD by 0.035 inch wall, such as stainless steel seamless tubing manufactured by TW Metals.

This attachment tubing is connected to the furnace by a furnace connection (discussed below), but there is a filter between the attachment tubing and the furnace connection. The filter is used just prior to the furnace connection to prevent particulate matter from plugging the sample line and from contaminating the analyzer.

The furnace connection connects the attachment tubing to the furnace. The furnace connection is a tube fitting. The tube fitting is preferably ¼ inch ODT Union Brass Parker #4-4 HBZ-B and ¼ inch ODT by ¼ inch MPT Male Connector Brass Parker #4-2 FBZ-B tube fittings. More preferably, the fitting is ¼ inch ODT Union Stainless Steel Parker #4-4-HBZ-SS-C and ¼ inch ODT by ¼ inch MPT Male Connector Stainless Steel Parker #4-4 FBZ-SS-C tube fittings.

These Parker ¼ inch tube fittings were used at both ends of the attachment tubing—the analyzer end and the furnace end. At the analyzer end, the attachment tubing was connected to the analyzer by these Parker ¼ inch tube fittings. At the furnace end, the attachment tubing was connected to the filter, which was connected to the furnace by these Parker ¼ inch tube fittings, which were connected to the furnace with a ½ inch pipe nipple, which was welded to the outside of the furnace. A ½ inch hole was drilled through the furnace shell to allow the furnace gas to enter the sampling line. A KNF Neuberger UN73MNI instrument pump was used to draw the sample from the furnace into the analyzer.

In addition to the sampling line that connects the furnace and the analyzer, there also is a vent. The sample is vented to the atmosphere after exiting the analyzer. The analyzer is discussed more fully below. In addition to the vent and the sampling line, the furnace also has at least one $N_2$ inlet injector, as discussed more fully below.

$CO_2$/CO Concentration Analyzer

To control the decarburization of steel components in a furnace during heat treating processes, the apparatus includes an analyzer to monitor the concentration of $CO_2$/CO in the furnace.

The $CO_2$/CO concentration may be monitored by various molecular spectroscopy devices, such as ultraviolet molecular absorption spectrometry, visible molecular absorption spectrometry, molecular luminescence spectrometry, raman spectroscopy, nuclear magnetic resonance spectroscopy, or molecular mass spectrometry. Preferably, the analyzer monitors $CO_2$/CO using an infrared sensor. Most preferably the analyzer is the Siemens UltraMat CO/ $CO_2$, which uses an infrared sensor. The analyzer is connected to the furnace by the aforementioned sampling line tubing attachment.

Using this molecular spectroscopy device, the analyzer continuously monitors the concentration of $CO_2$/CO in the furnace. The analyzer generates a signal indicating an elevated $CO_2$/CO concentration. Depending on the decarburization specification, an elevated concentration of $CO_2$ is preferably at least about 1500 ppm, more preferably at least about 1000 ppm, and most preferably at least 800 ppm. Alternatively, if CO is monitored, the elevated concentration of CO is preferably at least about 4500 ppm, more preferably at least about 3000 ppm and most preferably at least about 2000 ppm.

Another aspect of the invention consists of a continuous regulation: $CO_2$/CO concentrations are continuously monitored and, in correlation to the concentration level, a continuously changing flow control signal is sent to the valve train. In this embodiment of the invention, all the flow controlling elements (orifice plate, differential pressure gauge, globe valves and solenoid valves as represented in the block diagram of the invention) are replaced by a proportional valve which regulates the flow continuously between the higher flow rate and the lower flow rate, based upon the signal received from the controller. This continuous regulation allows a smoother adjustment of the inert gas flow rate, depending upon the level of $CO_2$/CO concentration at any time.

Processor

The signal from the analyzer is typically processed by a processor for controlling the RPH of inert gas that must be injected into the furnace to lower the elevated $CO_2$/CO concentration. The processor may be a personal computer. More preferably the processor is a program logic controller. Most preferably the processor is the Air Liquide data collection/PLC system "Teleflo." The signal from the analyzer representing the $CO_2$/CO composition (4–20 mA) is sent to the Air Liquide data collection/PLC system "Teleflo." Data from the analyzer along with temperature and time is stored in the Teleflo. The temperature signal is from a type K thermal couple inserted through the wall of the furnace.

When the signal from the analyzer indicates elevated $CO_2/CO$ concentration, the processor communicates with a gas injector which, responsive to the signal from the processor, injects inert gas (such as $N_2$) into the furnace at a flow rate of at least about 2 RPH. The elevated concentration of $CO_2/CO$ to which the gas injector responds can be adjusted depending on the decarburization specification—the desired degree to which the heat treating atmosphere is controlled or the extent to which one chooses to control the decarburization of the steel components.

Indeed, in some instances, a small amount of decarburization is preferable to zero decarburization, because a decarburization layer can be machined more easily during subsequent cold forming/machining operations. However, it is well known in the art that getting decarburization to occur is easy, but achieving a specific amount of decarburization consistently is extremely difficult because of the intense reactivity of some atmospheres (such as endogas) with the metal parts.

Another aspect of the invention allows one to produce small amounts of decarburization where the decarburization specification calls for it. This is done by regulating the concentration of $CO_2/CO$ in the furnace and making sure that a given concentration (or rather concentration profile) is repeated from load to load. Small decarburization is controllable because the decarburizing power of the furnace atmosphere can be monitored via the monitoring of the $CO_2/CO$ concentration profile. The atmosphere is not only monitored; it is regulated at any moment during the thermal cycle via flow rate changes based on a signal from the analyzer. Small decarburization is further controllable because highly reactive species like $H_2$ and CO are not used. Instead, inert gases such as $N_2$ are used.

Inert $N_2$ Gas Injector

The gas injector injects inert gas into the furnace. Only inert gas is injected by the gas injector, and no other species that might react in the furnace atmosphere. Injecting only inert gas dilutes the $CO_2$ and $H_2O$ impurities and alleviates the problems caused by other atmospheres. For example, hydrocarbons may scavenger the decarburizing species of $H_2O$ and $CO_2$, but may also react with oxides in the furnace to produce $H_2O$, which perpetuates the problem. Similarly, CO or $H_2$ may scavenger $H_2O$ and $CO_2$, but they also react with oxides to give $CO_2$ and $H_2O$.

The gas injector, responding to the processor, which processes a signal from the analyzer indicating elevated concentrations of $CO_2/CO$, injects the inert gas into the furnace at a flow rate of at least about 2 renewals per hour.

Yet another aspect of the invention calls for a flow rate of at least 2 RPH (higher flow rate), correlated to elevated $CO_2/CO$ concentrations, and for a lower flow rate the rest of the time. This is similar to a regulation by steps: $CO_2/CO$ concentrations are continuously monitored but, in correlation, only 2 values of the flow control signal are sent to the valve train: one for generating the higher flow rate (correlated to elevated concentrations) and one for generating the lower flow rate (for the rest of the time).

At elevated concentrations of $CO_2/CO$, the flow rate preferably is between about 2 and about 8 renewals per hour, more preferably between about 2 and about 5 renewals per hour, and most preferably between about 2 and about 3 renewals per hour.

If the $CO_2/CO$ concentration is not elevated, then there will be an absence of the signal indicating elevated concentrations of $CO_2/CO$. In such a case, a lower flow rate will be injected. A lower flow rate preferably is between about 0.1 and about 3 renewals per hour, more preferably between about 0.25 and about 2 renewals per hour, and most preferably between about 0.5 and about 1 renewals per hour.

Nitrogen Supply

To one skilled in the art, various inert gases may be used. Preferably, the inert gas is nitrogen, argon, or a mixture thereof, preferably containing less than 100 ppm of oxygen, water, or their combination, more preferably containing less than 10 ppm of oxygen, water, or their combination, and most preferably containing less than 5 ppm of oxygen, water, or their combination. Preferably the inert gas is cryogenic nitrogen.

Line Pressure

There is a gas line leading from the inert gas supply (such as $N_2$) to the gas injectors to the furnace. The pressure inside the nitrogen supply chamber is measured by a line pressure gauge.

Ball Valve

As shown in FIG. 2, there is a ball valve in the nitrogen line. The ball valve is a valve that stays fully open or fully closed. The ball valve preferably is a 1½ inch globe valve manufactured by NIPCO.

Solenoid Valve

Next, there is a solenoid valve in the inert gas line. This is a coil of wire, usually in a cylindrical form that, when carrying a current, acts like a magnet so that a movable core is drawn into the coil when a current flows and that is used to control the opening and closing of a valve. The solenoid valve preferably is a solenoid valve normally closed, one inch piping, Model No. 8210 B-54 and G-54, manufactured by ASCO.

Pressure Regulator

FIG. 2 next shows a pressure regulator. This maintains the gas pressure constant and equal to the calibration pressure of the orifice plate. Such pressure regulator is preferably a Speed Air model #6ZC27, 1½ inch tubing connection.

Orifice Plate & Differential Pressure Indicator (Flow Indicator)

Next in FIG. 2 is an orifice plate and a pressure differential indicator. The orifice is a hole through which the nitrogen passes. The pressure differential indicator indicates the flow rate of the inert gas. One skilled in the art should recognize that any other flow indicator device would also suit this purpose.

Glove Valves and Solenoid Valves

FIG. 2 next shows globe valves and a solenoid valve in the gas line. The solenoid valve is in communication with the processor. When increased flow rate is demanded by the processor, then the solenoid valve opens to increase the flow in the nitrogen line leading to the gas injector inlet into the furnace. For instance, to achieve 2 RPH in a 1,000 cubic foot furnace, the nitrogen line allows the passage of 2,000 cubic feet of nitrogen gas per hour.

The purpose of a globe valve is to restrict and therefore adjust the flow of gas passing through it. The two globe valves described in FIG. 2 can be manually adjusted to set up the valve of the higher flow rate and the valve of the lower flow rate.

Nitrogen Inlet (Injector)

The injector is a black pipe (carbon steel) schedule 40, 2 inch diameter, rated for pressure 100 psi maximum.

While the present invention has been described in terms of preferred embodiments, it is noted that this description has been provided by way of explanation and illustration. Clearly various alternatives to these preferred embodiments are possible and within the scope of this invention, the scope of which is defined by the appended claims.

We claim:

1. A method of controlling the decarburization of multiple batches of steel components during a heat treating process in a furnace, said components being made from a compositionally identical lot of steel and said components having a similar decarburization specification, the method comprising:

heat treating at least one batch of components, measuring and recording the concentration of $CO_2$/CO during the heat treating process to thereby develop a $CO_2$/CO concentration profile indicating times in the heat treating process when the $CO_2$/CO concentration is elevated above a predetermined level, heat treating subsequent batches of components, and injecting an inert gas into the furnace at a flow rate of at least about 2 renewals per hour at said times of said elevated concentrations in the $CO_2$CO according to the $CO_2$/CO concentration profile.

2. The method of claim 1 wherein $CO_2$ is monitored and the predetermined level of $CO_2$ is at least about 800 ppm.

3. The method of claim 1 wherein CO is monitored and the predetermined level of CO is at least about 2000 ppm.

4. The method of claim 1 wherein $CO_2$ is monitored and the predetermined level of $CO_2$ is at least about 1500 ppm.

5. The method of claim 1 wherein CO is monitored and the predetermined level of CO is at least about 4500 ppm.

6. The method of claim 1 wherein the predetermined level of $CO_2$/CO is adjusted depending on a decarburization specification for the steel components.

7. The method of claim 1 wherein the $CO_2$/CO concentration of at least one of said subsequent batches is measured and recorded at various times during the process to thereby redefine the $CO_2$/CO elevated concentration.

8. The method of claim 1 wherein the $CO_2$/CO concentration of at least one of said subsequent batches is measured and recorded at various times during the process to thereby redefine said concentration profile.

9. The method of claim 1 wherein the inert gas is nitrogen, argon or a mixture thereof.

10. The method of claim 1 wherein inert gas contains less than 100 ppm of oxygen and less than 100 ppm of water.

11. The method of claim 1 wherein inert gas contains less than 10 ppm of oxygen and less than 10 ppm of water.

12. The method of claim 1 wherein inert gas is cryogenic nitrogen.

13. The method of claim 1 wherein the gas injector injects inert gas into the furnace at a flow rate between about 2 and about 8 renewals per hour during said times of elevated concentrations in the $CO_2$/CO concentration profile.

14. The method of claim 13 wherein the gas injector injects inert gas into the furnace at a lower flow rate at times other than the times of elevated concentrations in the $CO_2$/CO concentration profile.

15. The method of claim 14 wherein the lower flow rate is adjusted at least high enough to maintain a minimum pressure inside the furnace.

16. The method of claim 14 wherein the flow rate is between about 2 and about 8 renewals per hour and the lower flow rate is between about 0.1 and about 3 renewals per hour.

17. The method of claim 14 wherein the flow rate is between about 2 and about 5 renewals per hour and the lower flow rate is between about 0.25 and about 2 renewals per hour.

18. The method of claim 14 wherein the flow rate is between about 2 and about 3 renewals per hour and the lower flow rate is between about 0.5 and about 1 renewals per hour.

19. A method for controlling the decarburization of metal components during a heat treating process in a furnace, the method comprising:

heating a batch of metal components in a furnace using a process defined by selected process conditions, said selected process conditions comprising at least one of temperature, flow rates, load, metal grade, and decarburization specification; and injecting an inert gas into the furnace during at least one period of elevated $CO_2$/CO concentration of the process;

wherein said at least one period of elevated $CO_2$/CO concentration is determined by monitoring the $CO_2$/CO concentration during a previous batch of the process run under the same said selected process conditions.

20. The method of claim 19, wherein the Inert gas is cryogenic nitrogen.

21. The method of claim 19, wherein the flow rate of the inert gas is continuously regulated.

22. The method of claim 19, wherein the $CO_2$ concentration is monitored and the elevated concentration is at least about 800 ppm.

23. The method of claim 19, wherein the $CO_2$ concentration is monitored and the elevated concentration is at least about 1500 ppm.

24. The method of claim 19, wherein the CO concentration is monitored and the elevated concentration is at least about 2000 ppm.

25. The method of claim 19, wherein the CO concentration is monitored and the elevated concentration is at least about 4500 ppm.

26. The method of claim 19, wherein said at least one period of elevated $CO_2$/CO concentrations is determined by:

defining a decarburization specification for the metal components;

determining the decarburization results of the process; and comparing said decarburization specification and said decarburization results.

27. The method of claim 19, wherein the metal components comprise steel.

28. The method of claim 19, wherein said inert gas is injected at a flow rate of at least about 2 renewals per hour.

29. The method of claim 28, where said inert gas is injected at a flow rate between about 2 and about 8 renewals per hour.

30. The method of claim 28, wherein said inert gas is injected into the furnace at a lower flow rate in the absence of elevated $CO_2$/CO concentrations.

31. The method of claim 30, wherein the lower flow rate is adjusted at least high enough to maintain a minimum pressure inside the furnace.

32. The method of claim 30, wherein the flow rate is between about 2 to about 8 renewals per hour and the lower flow rate is between about 0.1 and about 3 renewals per hour.

33. The method of claim 30, wherein the flow rate is between about 2 to about 5 renewals per hour and the lower flow rate is between about 0.25 and about 2 renewals per hour.

34. The method of claim 30, wherein the flow rate is between about 2 to about 3 renewals per hour and the lower flow rate is between about 0.5 and about 1 renewals per hour.

35. The method of claim 19, wherein the inert gas comprises at least one of nitrogen and argon.

36. The method of claim 35, wherein the inert gas contains less than 100 ppm of oxygen and less than 100 ppm of water.

37. The method of claim 35, wherein the inert gas contains less than 10 ppm of oxygen and less than 10 ppm of water.

38. A method for controlling the decarburization of steel components during a heat treating process in a furnace, the method comprising:

defining a decarburization specification for the steel components;

heat treating the steel components in the furnace under selected process conditions, said selected process conditions comprising at least one of temperature, flow rates, load, metal grade, and decarburization specification;

monitoring the $CO_2$/CO concentration during the process and establishing a $CO_2$/CO concentration profile for the process;

determining the decarburization results of the process;

defining at least one period of elevated $CO_2$/CO concentration based upon said decarburization specification and said decarburization results; and in subsequent process batches performed under the same said selected process conditions, injecting an inert gas into the furnace during said at least one period of elevated $CO_2$/CO concentration.

39. The method of claim 38, wherein said inert gas is injected at flow rate of at least 2 renewals per hour.

40. The method of claim 30, wherein said inert gas comprises nitrogen.

* * * * *